United States Patent [19]

Holmen

[11] 4,215,851

[45] Aug. 5, 1980

[54] SYSTEM FOR ACTIVE COMPENSATION OF UNWANTED RELATIVE MOVEMENTS, PREFERABLY DURING LOADING OF CARGO

[75] Inventor: Hans K. Holmen, Sandvika, Norway

[73] Assignee: A/S Strommen Staal, Strommen, Norway

[21] Appl. No.: 873,422

[22] Filed: Jan. 27, 1978

[30] Foreign Application Priority Data

Jan. 28, 1977 [NO] Norway ..... 770299

[51] Int. Cl.[2] ..... B66D 1/48

[52] U.S. Cl. ..... 254/277; 414/137; 91/390; 254/392

[58] Field of Search ..... 254/172, 173 R, 150 FH; 214/12, 14; 91/390; 92/62, 67, 76; 60/413, 416, 417, 907

[56] References Cited

U.S. PATENT DOCUMENTS

| | | | |
|---|---|---|---|
| 3,309,065 | 3/1967 | Prud'Hommo et al. | 254/172 |
| 3,511,476 | 5/1970 | Horton | 254/172 |
| 3,624,783 | 11/1971 | Chang | 254/172 |
| 3,807,277 | 4/1974 | La Spisa et al. | 91/390 |
| 3,871,622 | 3/1975 | Lanralde et al. | 254/172 |
| 3,912,227 | 10/1975 | Meeker et al. | 254/172 |

*Primary Examiner*—Kenneth W. Noland

*Attorney, Agent, or Firm*—Haseltine, Lake & Waters

[57] ABSTRACT

A system for active compensation of undesired relative movement particularly during loading of cargo comprising a long-periodic acting system for compensation of static loading caused by the load and a short-periodic acting system for active compensation of undesired relative movement of the load relative to a reference value. The long-periodic system includes a compensating cylinder provided with two pistons acting in opposite directions, the cylinder being connected to one or more pressure loaded reservoirs operating pneumatically. The short-periodic system includes at least one hydraulic cylinder and the position of the short-periodic system is determined by measurement of acceleration of the end of the loading crane beam by accelerometers.

9 Claims, 10 Drawing Figures

76
78
77
68
69
70
81
82
64, 62, 66
65, 63, 67
80, 79
60, 61
71
71
73
72
58
64
65
68
80
74
57
62
63
69
61
60
75
79
59
66
67
70
81
82
55
55''
56'
56
56''
55'''
55'
d
c
b
a

SYSTEM FOR ACTIVE COMPENSATION OF UNWANTED RELATIVE MOVEMENTS, PREFERABLY DURING LOADING OF CARGO

FIELD OF THE INVENTION

The present invention relates to a system for active compensation of unwanted relative movements, preferably during deposition of load (cargo), using a long-periodic acting system for compensation of a static loading caused by said load and a short-periodic acting system for compensation of unwanted relative movements of the load relative to a reference level.

BACKGROUND

During deposit of load by means of a floating crane to a stationary installation, during wave motion there may easily arise large relative movements of load relative to said installation.

Said relative movements may also produce overloading of the construction which performs the deposit of the load.

Upon deposit of a large load, e.g. in the amount of several hundred tons, the forces which are released upon impact created by such movements may produce great damage both to the load itself and the installation. In order to decrease the risk of such impact one is presently and substantially restricted to deposit of the load when the conditions for minimum relative movements are present, i.e. during low wave motion. Thus, such operations are likely to be postponed until the wave motion conditions are satisfactory.

From the prior art, known are systems to solve problems relating to unwanted movements. In U.S. Pat. No. 3,314,657 a passive system is described having the purpose of maintaining a predetermined tension in a cable by means of hydro pneumatic means. A piston cylinder is positioned between two pulleys and by variation of the movements of the piston relative to the cylinder the cable tensioning is altered as required. The patent, however, does not teach how the task may be solved when extremely large loads as well as transients result from relative movements. A wave motion compensating system is known to maintain a load which is suspended on a floating platform at substantially constant level and comprising a passive load carrying system having a resilient load carrying coupling which can be mounted between a fixed support on the platform and a load which is to be carried. The installation is based on a closed system, where increase in liquid pressure in a wave motion compensating cylinder causes transfer of liquid from said cylinder to a shock absorbing cylinder and upon the operation of the latter an increase in pressure in an associated closed pneumatic system. The installation thus attempts to achieve a load balance by means of a slightly increased liquid pressure. Also known is a wave motion compensator which intends to maintain the loading or the position constant for an object which is suspended from a floating vessel when the vessel moves up and down on the water surface. The compensator comprises a hydraulic servo system which can offer active assistance to a passive pneumatic system, such that said loading or position is kept within predetermined narrow limits even when the movements of the vessel are quite large. The compensator, however, requires that the pressure which is present in the compensator cylinder is sufficient both to hold the load, in the example shown a drilling wire, and compensate for the present movements due to wave motion. As a consequence the "passive" compensating pressure necessarily becomes particularly high even though the "active" compensating pressure variations are small.

SUMMARY OF THE INVENTION

The present invention thus aims in solving the problems relating to disposition of heavy loads and which cannot be solved in a proper manner by said means.

The characterizing features of the present invention will appear from the attached claims as well as the description herein after with reference to the drawings.

DETAILED DESCRIPTION

Figure 1:
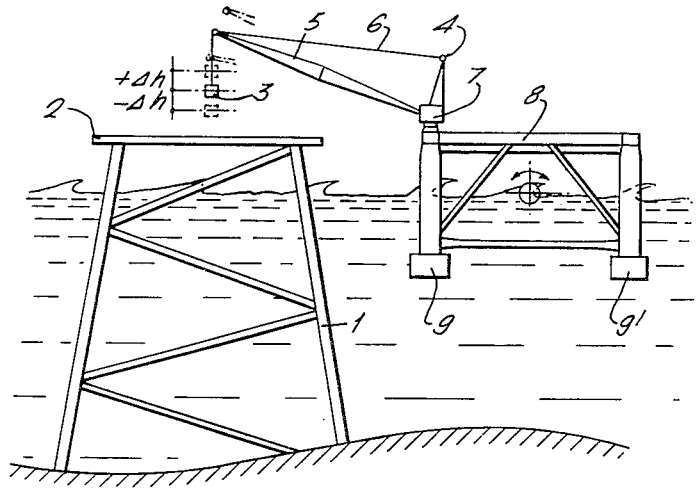
FIG. 1 illustrates dispositioning of load to a stationary installation by means of a floating crane.

In FIG. 1 there is shown a stationary installation 1, e.g. a platform mounted on an oil drilling field, which platform has a deck 2 on which a load 3 is to be placed. The load 3 is here considered to have a substantial weight, e.g 50–100 tons. The load may be moved by means of a floating crane 4 consisting of crane beam 5 operation wire or wires 6, pilot cabin 7, a deck 8 and buoyancy elements 9 and 9'. Upon wave movement, the floating crane will be given an angular velocity $\omega$. Upon such movement the load will move a small distance up and down as indicated by $+\Delta h$ and $-\Delta h$. The rectilinear movement of the load 3 will have a velocity v.

Figure 2:
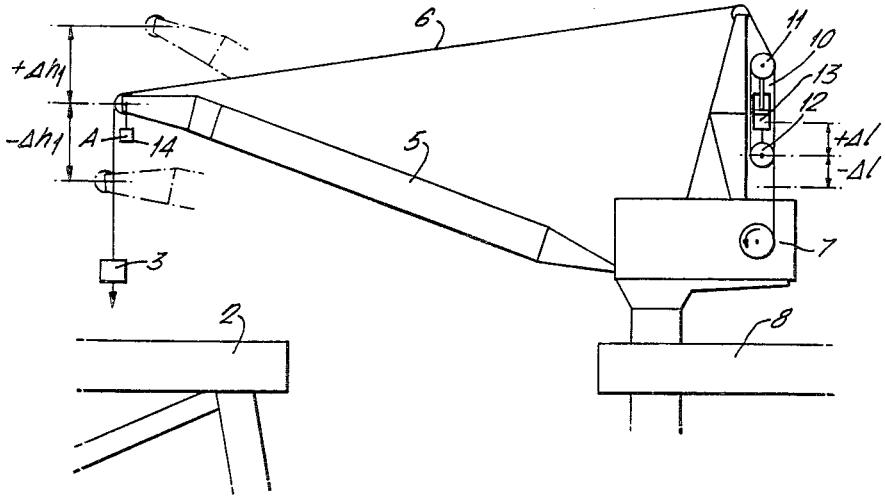
FIG. 2 illustrates the system in FIG. 1 in enlarged scale.

The invention will now be described more specifically with reference to FIG. 2. With an angular velocity $\omega$ as a result of e.g. wave motion the loading beam 5 will have a movement as shown in the figure. The outer end of the beam moves over corresponding distances $+\Delta h_1$ and $-\Delta h_1$. This movement must be compensated and this can be carried out by means of a pulley system where the number of parts in the system are equal to t and where the change $\Delta h_1$ is equal to $t \times \Delta l$, where $\Delta l$ is the length of each portion being altered. The system 10 consists of pulley blocks 11 and 12 as well as pressure means 13 positioned between the said blocks. At the outer end of the crane beam 5 an accelero-meter 14 is attached, said accelerometer sensing vertical movements of the outer end of the beam and therefore also the vertical movement of the load 3. Despite the fact that the movement of the beam 5 is greatly compensated by means of the system 10 there will still be present some vertical movements $\Delta h_2$ at the load 3, which vertical movements must be made as small as possible.

For compensating the said unwanted movements relative to the deck 2 at is proposed, according to FIG.

3, to have a pressure cylinder 13 consisting of a piston 14, a cylinder 15 and a piston rod 16. At the outer ends 17 and 18 pulleys 11 and 12, respectively, are mounted. The movement of the piston 14 will, in the embodiment shown, be a total of $2\times\Delta l$. A liquid pressure $V_1$ acting against the piston 14 is supplied from a pressure source 19 consisting of a pressure cylinder having an air volume or inert gas volume $V_2$ and a nominal liquid volume $V_1$. In a preferred embodiment $V_2\approx 10\times V_1$.

In order to keep the energy consumption of the compensator $P_2$ should be equal to $P_1$. If $P_2<P_1$ air or gas is supplied by means of the pump 20 to volume $V_2$. If $P_2>P_1$ air or gas is released from the volume $V_2$. In order to ensure a quick compensation for even small changes there has been arranged a heavy duty liquid pump 21 which can feed liquid in one or the other direction as indicated in the figure by arrows. The pump is driven by a motor 22.

Figure 3:
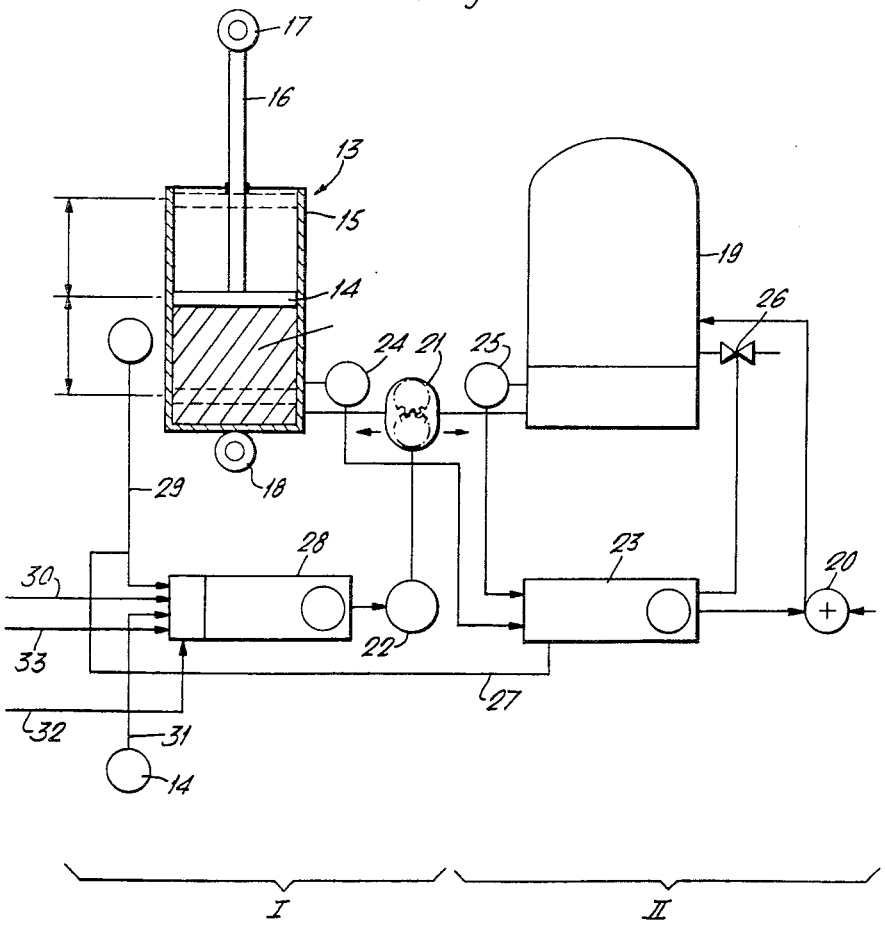
FIG. 3 shows a system according to the invention.

II indicates the long-periodic system of FIG. 3, where the period preferably is greater than 25 seconds. A logic unit 23 is connected to pressure sensor 24 (for measuring the pressure $P_1$) and to pressure sensor 25 (for measuring the pressure $P_2$) and the outputs of the logic unit are connected to the valve 26 and the pump 20. A further input to the logic unit 23 is the nominal value $L_o$ which is fed through wire 27 to the unit 23, $L_o$ designating the the deviation from the nominal position of the piston 14. The logic unit 23 will preferably have a time delay of approximately 5 seconds in order to ensure that only the long-periodic movements are compensated.

The motor 22 driving the pump 21 is controlled by a logic unit 28 the input signals of which comprise signals representative of the instantaneous position of the piston 14, said signals being fed through the wire 29. Further through the cable 30 there is fed known parameters as e.g. elasticity of the load cable and the crane structure, and further signals from the accelero-meter 14 is fed through the line 31.

Figure 5A:
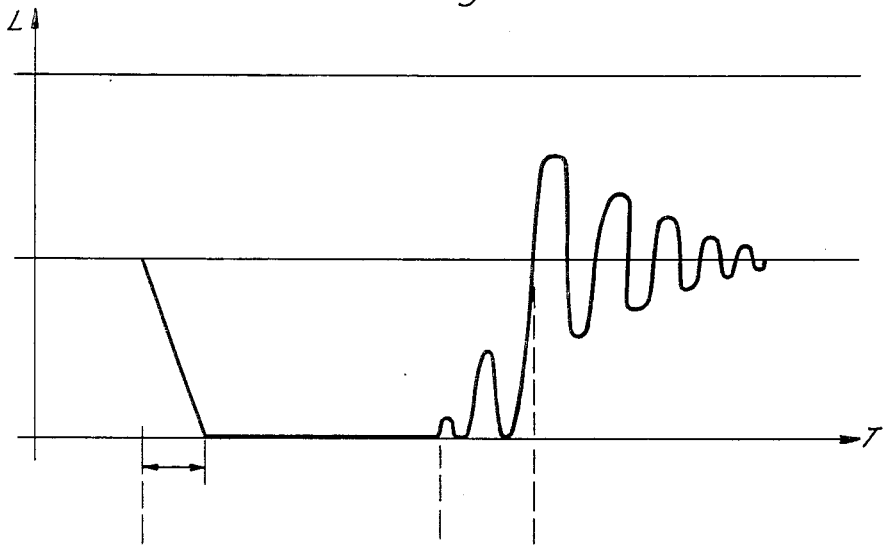
FIGS. 5*a* and *b* are diagrams for a closer understanding of the system according to FIG. 4.
Figure 5B:
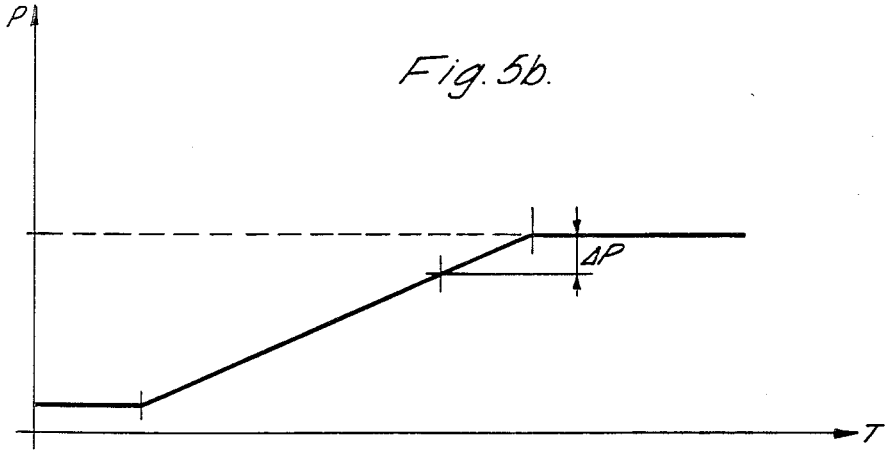
Figure 6:
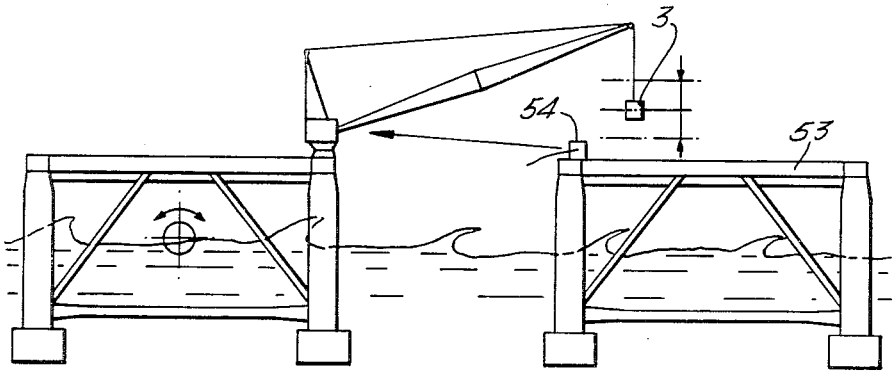
FIG. 6 illustrates dispositioning of load on a moveable, e.g. floating support by means of a floating crane.

As will appear from, inter alia, the description in connection with FIGS. 5 and 6 information may be fed through the line 32 from the load yoke from which the load is suspended and if the support, upon which the load is to by placed, is moveable information may be fed through the line 32 be regarding the moveable pattern of movements of said support relative to the floating crane. The portion of the system thus labelled I is the short-periodic part having a typical period of approximately 5 seconds. The portion thus takes care of the dynamic variations in movement.

Although the system of FIG. 3 is technically realizable there will be some problems associated with the pump 21. Relative to atmospheric pressure, the pump will have to be exposed to such a heavy pressure that problems will exist with regard to keeping the pump tight.

Figure 4:
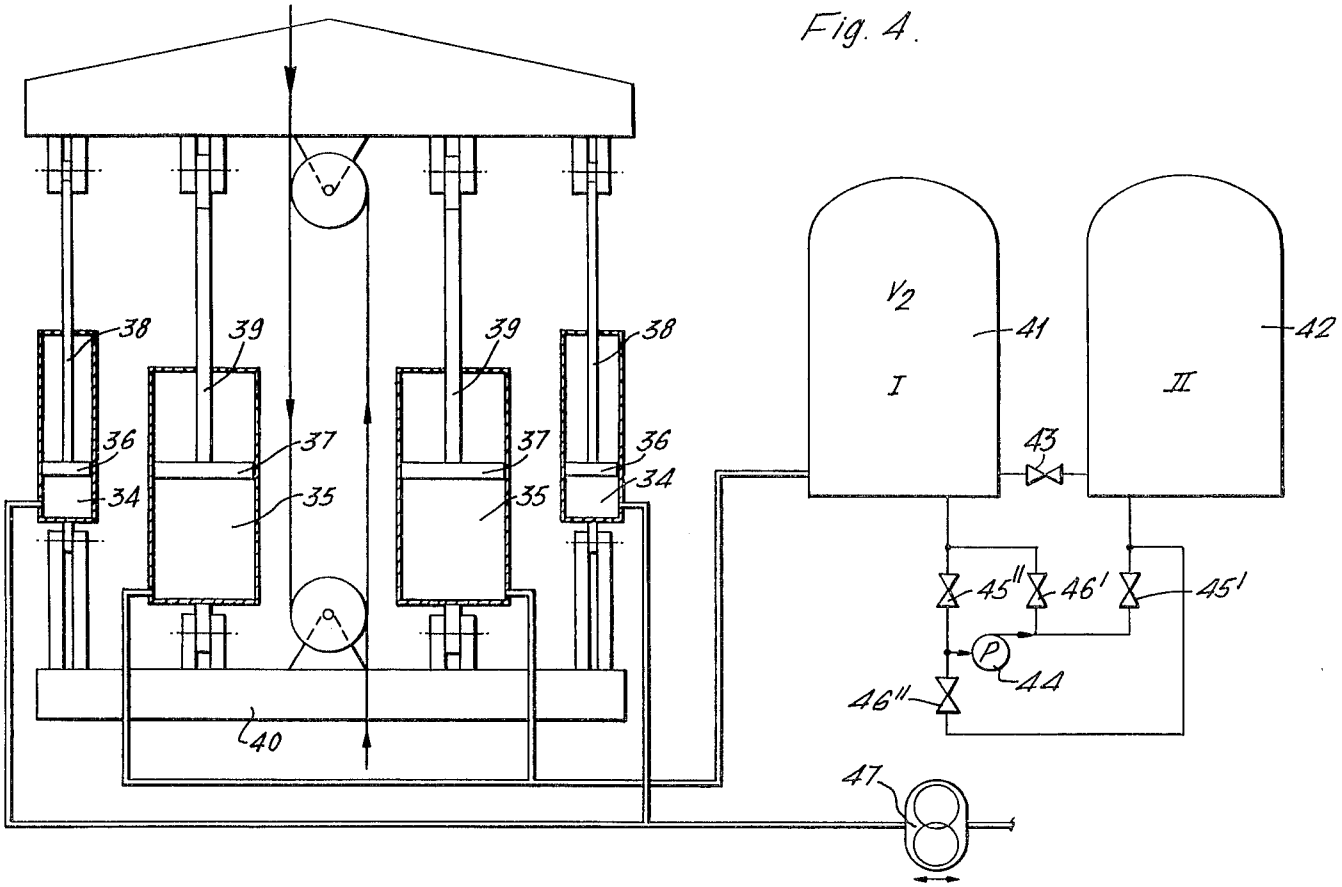
FIG. 4 shows a modified, practical embodiment of the system according to the invention.

According to FIG. 4 there is thus proposed a modification of the system according to FIG. 3.

In FIG. 4 the right hand portion is the long-periodic system and in principle a balancing system. The left hand portion takes care of the active compensation of the unwanted relative movements. Thus, as seen, the pressure means 13 of FIG. 3 is here replaced by two cylinders 34 and 35 with pistons 36 and 37 and piston rods 38 and 39, respectively. The piston rods 38 and 39 are connected to a common link 40. The cylinder 35 has a supply of air or inert gas from a pressure cylinder 41 having an extra pressure cylinder 42 connected through a valve 43. The pump 44 maintains the pressure in the cylinder 41 at the required pressure. This is carried out as described in connection with the pump 20 of FIG. 3, and when supply from the unit 41 to unit 42 is to be made, the valves 45' and 45'' are opened, whereas when supply of air or gas is to be made from the supply 42 to the supply 41 the valves 46' and 46'' are opened. The relative movements of the short-periodic system are handled by the pump 47 which in this case may be connected to a conventional reservoir or a liquid pressure source having a nominal pressure which is substantially less than the pressure acting on the pump 21 in FIG. 3.

In FIG. 5*a* it is shown how the system 10, upon loading, goes from the neutral position $L_o$ to the lower stopper and as a result of the increases in the balancing pressure gradually is brought back to the neutral position $L_o$.

The corresponding diagram is shown in FIG. 5*b*, where in the cylinder 35 there is present a load yoke pressure, and upon loading there is an increase of said pressure until the balancing pressure or the load carrying pressure at the neutral position $L_o$ is reached. The hydraulic cylinder 34 will take care of the variations in the pressure $\Delta P$ which take place due to unwanted relative movement.

In FIG. 6 there is shown an embodiment where the load is to be placed upon a moveable support, e.g. floating platform. The floating cranes will here have the same angular velocities as previously discussed and the only new parameter which must be registered is the instantaneous movement of the platform deck 53 relative to the load 3 which is in motion. This can be made by an accelerometer 54 mounted on the platform deck 53 and where the transfer of data from the accelerometer 54 to the logic unit 28 is by wireless communication.

Figure 7:
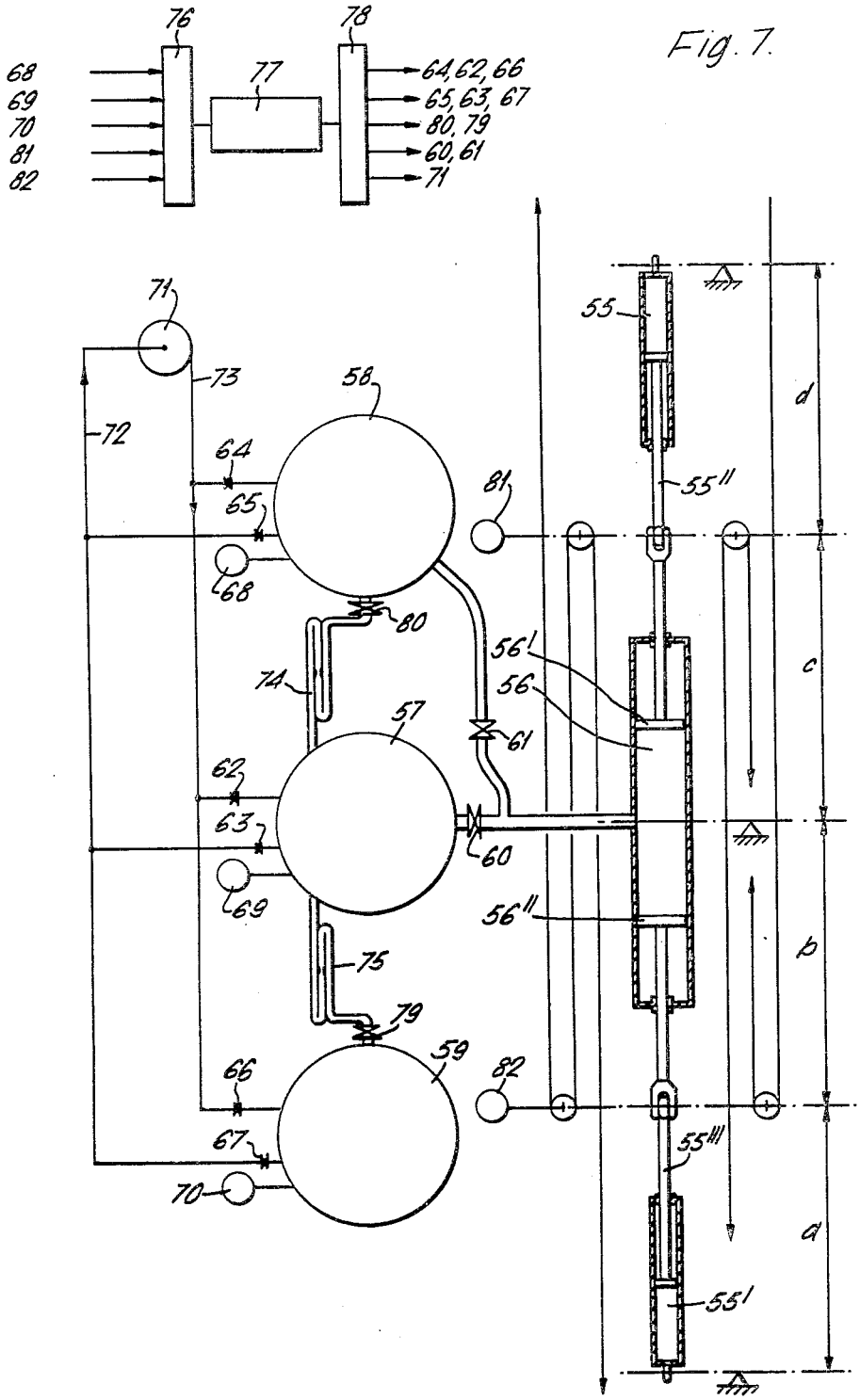
FIG. 7 shows a modified embodiment of the system according to FIGS. 3 and 4.

In FIG. 7 is shown a modified embodiment of the system in FIGS. 3 and 4. The short-periodic system includes two hydraulic cylinders 55, 55', one end of which is fixedly mounted on the crane or other fixed support. The piston rods 55'' and 55''' of the two cylinders are respectively connected to the pistons 56' and 56'' of a pneumatic double-piston cylinder 56 which is included in the long-periodic system. The cylinder 55 compensates for a displacement $L_1$ measured by the position gauge 81, and the cylinder 55' compensates for a displacement $L_2$ measured by the position gauge 82. At a position of equilibrium, the distances a, b, c, d are preferably and mutually the same.

For compensation of variations in loading by means of the long-periodic system the pneumatic cylinder 56 is in communication with a pressure tank 57 through a valve 60. In a preferred embodiment where three reservoirs having the same volume are used, the pressure tank 57 has a nominal pressure large enough to carry the load and a volume which is large relative to the cylinder volume. The tank 57 constitutes the working reservoir for the cylinder 56. The working cylinder 56 is also connected to a low pressure reservoir 58, the nominal pressure of which is low. The connection from tank 58 to the cylinder 56 is made either through the valve 61 or through a choke valve and heat exchanger 74 and a valve 80 in communication with said working reservoir 57.

A high pressure reservoir 59 is connected to the working reservoir through a valve 79 and a choke valve and a heat exchanger 75. The container 59 has preferably a high nominal pressure.

The container 58 is connected to a pressure gauge 68. The container or tank 57 is connected to a pressure gauge 69. The tank 59 is connected to a pressure gauge 70.

The compressor 71 is provided with a suction pipe 72 and a pressure pipe 73. In order to maintain nominal pressure in the tanks 58, 57 and 59, a selective control of the valves 64, 65; 62, 63; 66, 67, can be made.

Measurement data from the pressure gauges 68, 69 and 70 as well from the loading gauge 81 and 82 are fed into an input block 76 which through a logic device 77 and an output block 78 causes respective opening or closing of one or more of the valves 64, 62, 66, 65, 63, 67, 80, 79, 60, 61 as well as start or stop of the compressor 71.

Figure 8:
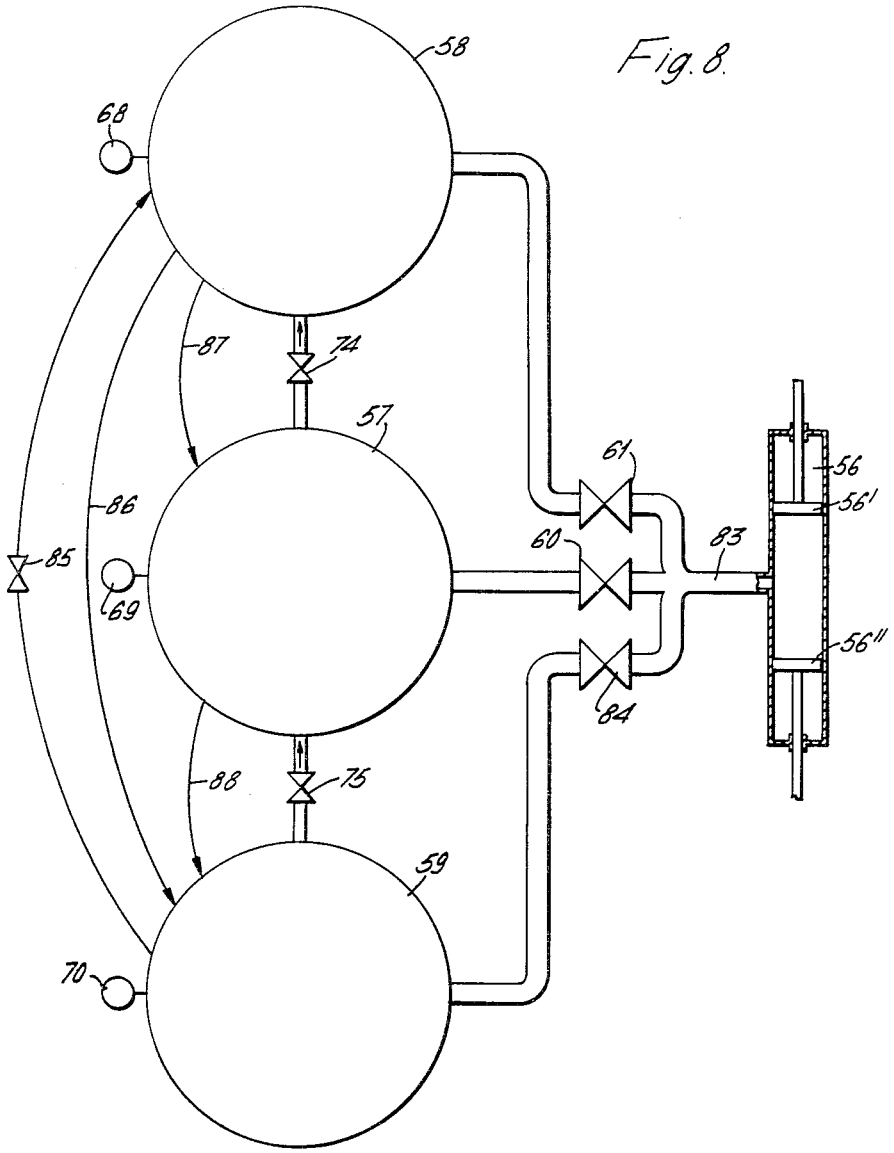
FIG. 8 is a modification of the system of FIG. 7.

FIG. 8 is a modification of the device in FIG. 7. The compensation cylinder 56 is supplied with a pressure medium through a feeding pipe 83 which communicates with the valves 61, 60 and 84. The valves 61, 60 and 84 are respectively in communication with the pressure tanks 58, 57 and 59. The heat exchanger 74 between the tanks 58 and 57 is necessary in order to compensate for heat generation or cooling effect upon large pressure transients. The heat exchanger 75 has a corresponding operation.

The volume of the containers 58, 57 and 59 are preferably the same, so that $R_A$ is equal to $R_B$ which is equal to $R_C$.

The relationship between the nominal pressure are, in the example chosen, 1:3:6.

The working ranges of the cylinders have been indicated in the figure.

In order to change the pressure in the tank 58 or 59, the valve 85 may be opened. This will correspond to opening of the valves 64 and 66 in FIG. 7.

Between the tanks 58 and 59 there is arranged a compressor which is suitable for operation from a high pressure to an even higher pressure. The compressor is indicated by the operational arrow 86. A corresponding compressor is found between the tanks 58 and 57, labelled by the operational arrow 87 and between the tanks 57 and 59, labelled by the operational arrow 88.

In the example chosen, the valve 61 is suitable for e.g. a load between 0 and 60 tons, the valve 60 for a load between 60 and 130 tons and the valve 84 for a load between 130 and 200 tons. These are only chosen examples and are not necessarily restrictive to the working range.

By using compressors operating between a high pressure and an even higher pressure, one may use modern and cheap compressors having a moderate power consumption relative to compressors which have to operate between atmospheric pressure and operational pressure.

The system of FIG. 8 makes use of three tanks or reservoirs which form part of a closed system and one may therefore make use of inert gas for operational purposes.

The system of FIG. 8 makes possible that the loading time to be a minimum. The loading time is a substantial factor when the same hoisting device is to operate with minimum and maximum loading subsequently. In extreme cases it may take up to 24 hours to establish the sufficient working pressure. This problem is alleviated to a substantial extent by the present system.

By using a double-acting compensation cylinder 56 the piston velocity is only one half relative to that of a single cylinder, since piston velocity greater than 1 meter per second should be avoided.

This is a substantial advantage since thereby it is possible to compensate for twice the velocities of the crane beam tip.

Figure 9:
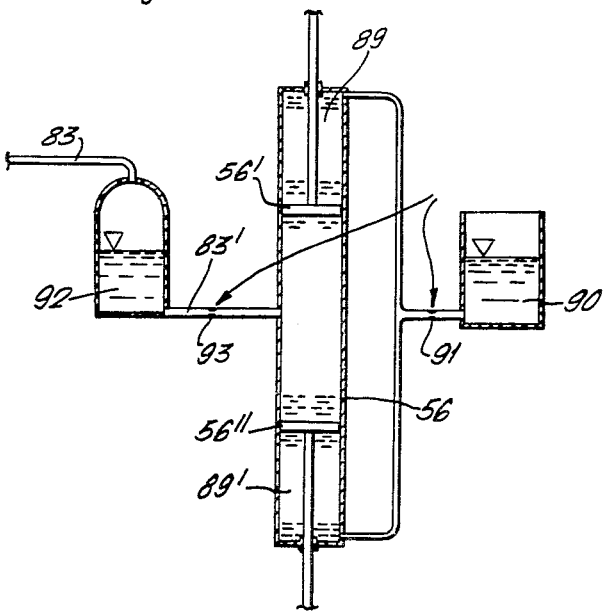
FIG. 9 shows a safety device incorporated in the system according to the invention.

In FIG. 9 is shown a safety device to be used in connection with the compensation cylinder 56. At the top side of the pistons 56' and 56'' hydraulic oil 89 and 89' has been introduced from a low pressure reservoir 90. In the supply pipes to the oil volumes 89 and 89' is included a choke valve 91 which operates upon large flow-through velocities. One has now a pneumatic cylinder with a liquid piston.

At the lower side of the pistons are supplied in a modified embodiment of FIG. 8, liquid through a gas pressure/liquid pressure converter 92. The converter 92 thus serves as a high pressure reservoir for the cylinder 56. The volume of the reservoir 92 must at least be equal to the total volume of the cylinder 56. The liquid is carried through the pipe 83' and a choke valve 93 to the working cylinder, as will appear from FIG. 10. The gas pressure pipe 83 leads to the valves 61, 60 and 84 as shown in FIG. 9.

The purpose of the device in FIG. 9 is to prevent the pistons in the cylinder 56 to be shot out from the cylinder, for example, upon wire fracture when there no longer is any counter-force against the pressure action of the pistons. The hydraulic oil 89 and 89' as well as the choke valve 91 will act as an effective shock damper and substantially reduce mechanical damage and possible injuries to human beings. The valve 93 serves the same function since it will be blocked upon too large flow-through through the supply pipe 83.

I claim:

1. A system for active compensation of unwanted relative movements, preferably during deposit of load by a crane beam, comprising a long-periodic acting system for compensation of the static loading caused by said load and a short-periodic acting system for active compensation of unwanted relative movements of the load relative to a reference level, said long-periodic system comprising a compensating cylinder provided with two pistons acting in opposite directions, said cylinder being connected through connector means to one or more pressure loaded reservoirs, said long-periodic system being pneumatic using air or inert gas as an operational medium, said short-periodic system comprising two hydraulic cylinders with respective pistons, said pistons of the short-periodic system including piston rods connected to said pistons of the long-periodic acting system, the position of said short periodic system being determined by the measurement of at least one parameter involving movement of the tip of the crane beam, movement of the load, or movement of said reference level.

2. A system according to claim 1, comprising three of said pressure loaded reservoirs and a heat exchanger arranged between at least two of said reservoirs.

3. A system according to claim 1, comprising three of said pressure loaded reservoirs and a compressor arranged between at least two of said reservoirs, said compressor compressing from a high pressure to a more elevated pressure.

4. System according to claim 1 comprising a choke valve and a low pressure reservoir and wherein the bottom of the pistons in said cylinder are supplied with liquid at low pressure, said amount of liquid at high flow-through velocities through said choke valve communicating with a reservoir causing closure of the valve.

5. System according to claim 1, comprising, a pneumatic/hydraulic converter included in the long-periodic system between said connector means 84) and the compensating cylinder.

6. A system as claimed in claim 1, characterized in that the short periodic system includes means for detection of relative movements of the load relative to a reference level, said means including accelerometers, each of said accelerometers being attached to the outer end of the crane beam, to the load or to the yoke to which the load is attached, respectively, and also to said reference level when the same is in motion, and a logic comparator for comparing measurements from said accelerometers.

7. A system according to claim 6, wherein the comparator comprises an analogue to a digital converter.

8. A system according to claim 1, comprising three of said pressure loaded reservoirs and a compensating heat exchanger arranged between at least two of said reservoirs.

9. A system according to claim 1, comprising three of said pressure loaded reservoirs and a compressor arranged between at least two of said reservoirs, said compressor compressing from a high pressure to a more elevated pressure.

* * * * *